US005463415A

United States Patent [19]

McCann et al.

[11] Patent Number: 5,463,415

[45] Date of Patent: Oct. 31, 1995

[54] FOUR INCH PRINT ENGINE MODULE

[75] Inventors: James D. McCann, Waynesville; Randal L. Mullins, Jamestown, both of Ohio

[73] Assignee: Scitex Digital Printing, Inc., Dayton, Ohio

[21] Appl. No.: 891,334

[22] Filed: May 29, 1992

[51] Int. Cl.[6] ..... B41J 2/02

[52] U.S. Cl. ..... 347/74; 347/108

[58] Field of Search ..... 347/4, 49, 74, 347/85, 108; 361/725, 730

[56] References Cited

U.S. PATENT DOCUMENTS 4,378,564 3/1983 Cross et al. ..... 347/4 X
4,591,870 5/1986 Braun et al. .
4,623,897 11/1986 Brown et al. .
4,739,445 4/1988 Tragen ..... 361/725 X
4,792,817 12/1988 Barney ..... 347/4
4,811,035 3/1989 Huliba et al. ..... 347/49 X

*Primary Examiner*—Joan H. Pendegrass
*Attorney, Agent, or Firm*—Barbara Joan Haushalter

[57] ABSTRACT

A print engine module for use with a remote print head is an integral unit having removable drawers and permanently installed drawers, each drawer containing a component of an ink jet printer. The removable drawers contain a fluid system unit, a charge power unit, a power supply unit, and a card cage unit. Also within the print engine module are two fixed components that are in drawers permanently attached to the print engine module cabinet. The permanent units include power distribution unit and a computer unit.

14 Claims, 3 Drawing Sheets

FOUR INCH PRINT ENGINE MODULE

TECHNICAL FIELD

The present invention relates to continuous ink jet printers and, more particularly, to an integral module for containing components of a print engine.

BACKGROUND ART

Ink jet printing systems are known in which a print head defines one or more rows of orifices which receive an electrically conductive recording fluid from a pressurized fluid supply manifold and eject the fluid in rows of parallel streams. Printers using such print heads accomplish graphic reproduction by selectively charging and deflecting the drops in each of the streams and depositing at least some of the drops on a print receiving medium, while others of the drops strike a drop catcher device.

Ink jet printers have various components, most of which are packaged in separate units, then used together. For example, a typical ink jet printer includes a fluid system, print head, umbilical, data system, and associated electronics for control of the devices. For certain applications, it would be desirable to package these components compactly. For example, U.S. Pat. Nos. 4,591,870 and 4,623,897 describe a continuous ink jet printer intended for use in an office environment. To meet the requirements of such an environment, the printer must be relatively compact. The office environment also requires that the printer be substantially free from complicated user maintenance. However, these systems are much too small for some applications. They operate a print head with 60 jets, whereas it would be desirable to operate a print head with multiply more jets, such as 1024. It would also be desirable to have greater paper throughput in many applications. Finally, the '870 patent and other prior art have the paper handling and storage as part of the printer, whereas it would be desirable in some applications to have paper handling performed by a large roll-to-roll system similar to that used in offset web printing.

It is seen then that there exists a need for a compact, integral print engine module which is easy to test and install, which can be used with a remote print head, and in which the paper handling is performed by a large roll-to-roll system.

SUMMARY OF THE INVENTION

This need is met by the system according to the present invention, wherein a print engine module contains a plurality of drawers, with each drawer containing a component of an ink jet printer. The drawers can be easily built, tested, and installed in the integral print engine module cabinet.

In accordance with one aspect of the present invention, a print engine module contains, in an integral unit, a plurality of removable drawers and a plurality of permanently installed drawers, each drawer containing a component of an ink jet printer. The removable drawers contain a fluid system unit, a charge power unit, a power supply unit, and a card cage unit. Also within the print engine module are two fixed components that are permanently attached to the print engine module cabinet. The permanent units include a power distribution unit and a computer unit.

Accordingly, it is an object of the present invention to provide an integral, compact print engine module which can be used with a remote print head. It is an advantage of the present invention that the individual units which comprise the integral print engine module can be easily built, tested, and installed in the cabinet.

Other objects and advantages of the invention will be apparent from the following description, the accompanying drawings and the appended claims.

DETAILED DESCRIPTION OF THE PREFERRED EMBODIMENTS

Figure 1:
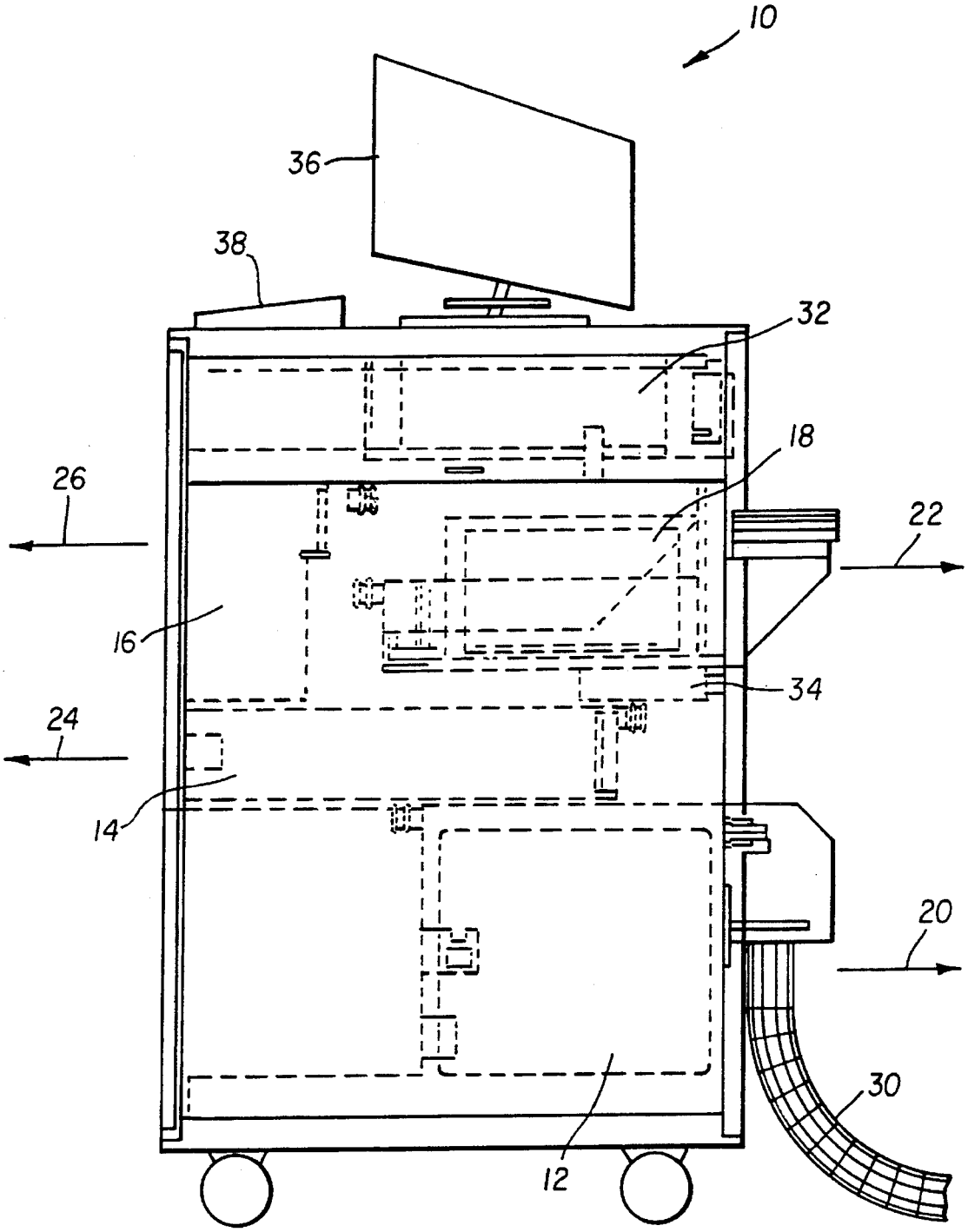
FIG. 1 is a side view of a print engine module of the present invention, the print engine module having a plurality of units.
Figure 2:
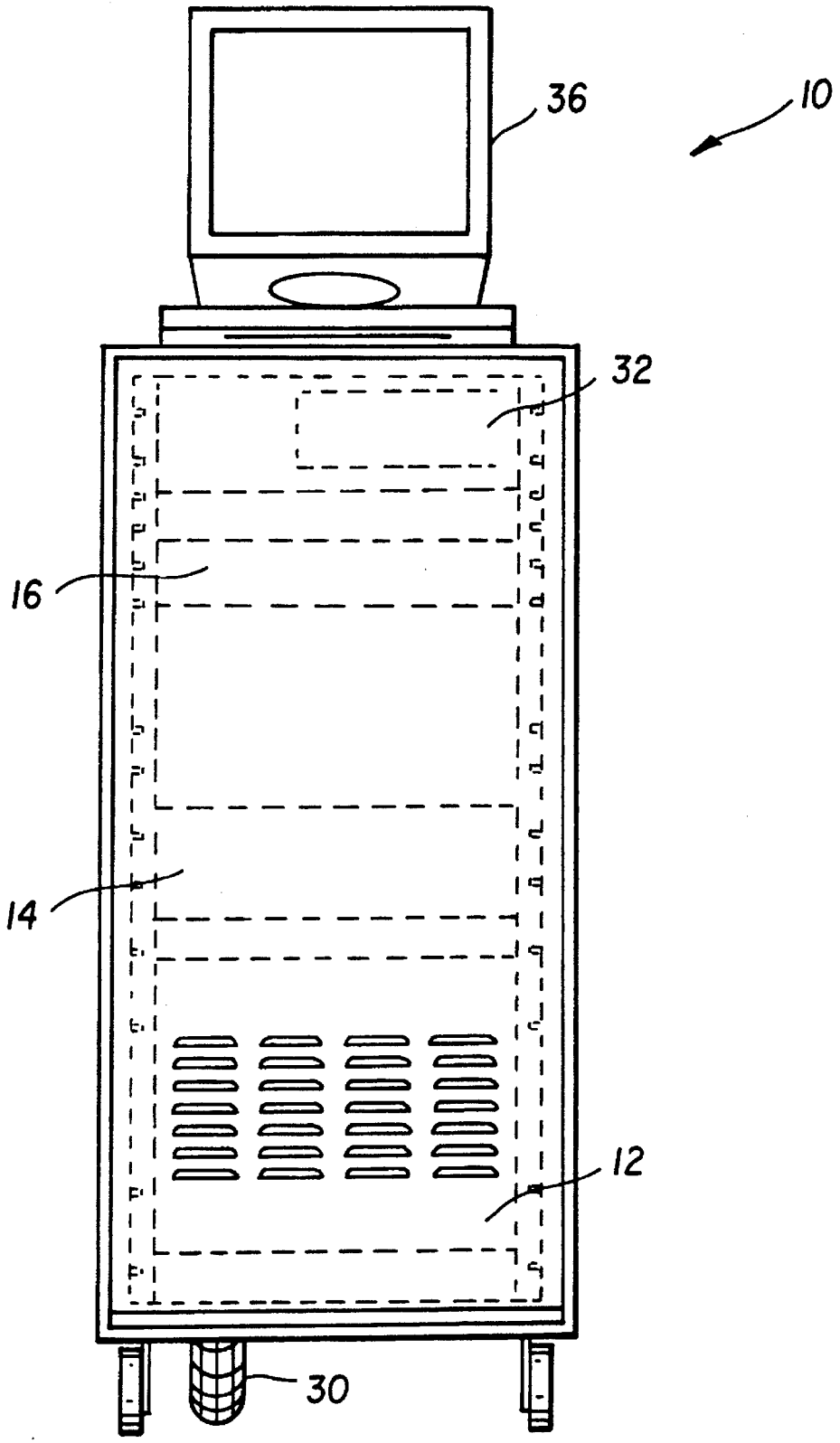
FIG. 2 is a front view of the print engine module of FIG. 1.

Referring to the drawings, in FIGS. 1 and 2, a side and front view, respectively, of a print engine module of the present invention, is illustrated. The print engine module, generally designated 10, has a plurality of units, installed as separate drawers which are removable and replaceable by sliding each unit out and replacing it with a new unit. Thus, the time to replace any unit is greatly reduced.

The units are contained as removable drawers in a housing or cabinet 11 of the print engine module 10. The units of FIGS. 1 and 2, comprise critical components of an ink jet printer system. In a preferred embodiment, the print engine module 10 includes a removable fluid system unit 12, a removable charge power unit 14, a removable power supply unit 16, and a removable card cage assembly unit 18. The fluid system unit 12 and the removable card cage assembly unit 18 can be slid out of the module 10 in the direction of arrows 20 and 22, respectively. Similarly, the charge power supply unit 14 and the removable power supply assembly unit 16 can be slid out of the module 10 in the direction of arrows 24 and 26, respectively.

In the integral print engine module 10 of FIGS. 1 and 2, the fluid system unit 12 typically contains the fluid system and associated cables. The cables are preferably contained on a retractor means 28, best illustrated in FIGS. 3A and 3B and described in more detail below. The fluid system unit 12 also includes means for mounting the fluid system within the integral print engine module 10, such as the necessary bracketry and mounting hardware needed to install the unit 12 in the cabinet 11. Finally, the fluid system unit 12 includes an umbilical interface 30 for interfacing the print engine module 10 with a remote print head.

Continuing with FIGS. 1 and 2, the charge power unit 14 contains a programmable power supply for applying the proper charge voltage to the ink jet drops, and a second power supply for providing power to the programmable power supply. An AC power conditioner provides power to the power supply unit 16 and to a computer unit 32, described in more detail below. Again, the charge power unit 14 includes associated cables and a retractor means 28 for containing the cables. A vacuum pump relay and an ink heater relay may also be located in the charge power supply unit 14.

The power supply unit 16, which receives power from the AC power conditioner of the charge power supply unit 14, contains all other necessary power supplies. For example, the power supply unit 16 may contain +5, −5, +12, −12, and +24 power supplies to provide power to the fluid system unit 12 and any electromechanical components in the fluid system unit 12 or the remote print head.

The card cage assembly unit 18 contains a mother board and may also contain one or more, and preferably three, daughter boards. The mother/daughter plug-in arrangement facilitates manufacture and ease of service of the ink jet printer. These printed circuit boards provide the necessary signals to actuate motors, solenoids, concentration measuring devices, and stimulation or drop generation, as the associated computer 32 directs. These boards also receive signals, (e.g. pressure, vacuum, temperature) and process the signals before the signals are input to the computer 32. Again, associated cables can be contained on a retractor means 28.

The fluid system unit 12, the charge power unit 14, the power supply unit 16, and the removable card cage assembly unit 18 are removable and replaceable units. However, the print engine module 10 may also include permanently installed units for one or more functions. In a preferred embodiment of the invention, the print engine module 10 includes the computer unit 32 and a power distribution unit 34. The computer unit 32 is the control means for the print engine module 10 and the remote print head. The control means for the print engine module 10 may also include a display means, such as a CRT monitor 36, and a data entering means, such as a keyboard 38, located on top of the module 10, or in any suitable location.

Continuing with FIGS. 1 and 2, the power distribution unit 34 provides the AC power needed by the components within the print engine module 10. A built-in circuit breaker may be included for providing protection to the print engine module 10 and disconnecting all power within the print engine module 10 for the purpose of servicing or removing the module 10.

Figure 3A:
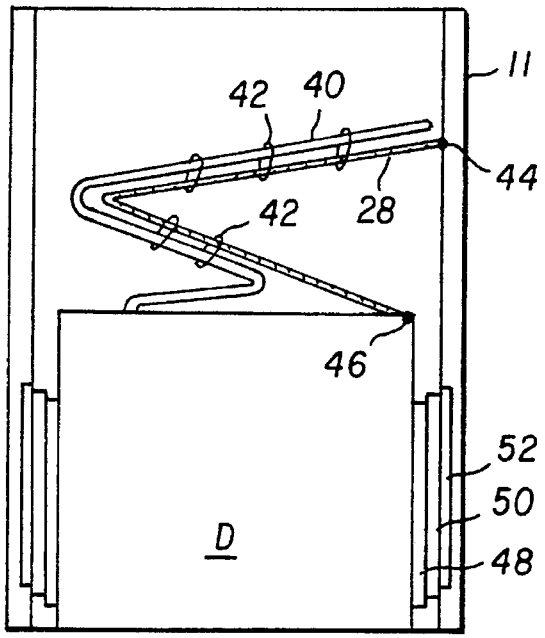
FIGS. 3A and 3B are top views of any one unit from the print engine module of FIGS. 1 and 2, showing retractor means for containing cables of the units, with the unit in a closed position and an open position, respectively.
Figure 3B:
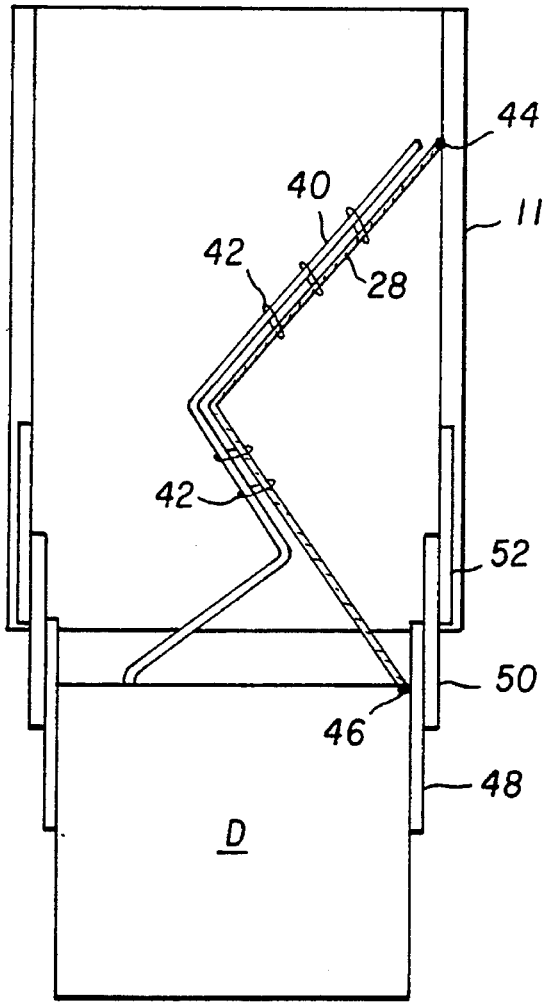

Referring now to FIGS. 3A and 3B, the cable retractor/carrier means 28 allows associated cables converging at the back of each movable or slidable unit 12, 14, 16, and 18, to be captured in such a manner that the moving unit or drawer, generally designated D, and referring to any unit 12, 14, 16, or 18, can be pulled in and out without pinching, catching, or damaging the cables. In FIG. 3A, the drawer unit D is in a closed position, with its associated cables 40 being secured by any suitable means, such as plastic tyraps 42 or a flexible cable clamp, to the retractor 28. In FIG. 3B, when the drawer unit D is opened, the retractor 28 and the associated cables 42 extend, without slipping into a position which would cause damage to the cables 42 when the drawer unit D is closed.

Continuing with FIGS. 3A and 3B, the retractor or carrier 28 is attached to the cabinet 11 by a first fixed hinge point 44 and attached to the drawer unit D by a second fixed hinge point 46. Each removable drawer unit D is permanently attachable to a slide bar 48, and further attachable to a telescoping slide 50 and a capture clamp 52, the combination of all of which maximizes the drawer D extension. The capture clamp 52 is preferably permanently attached to the cabinet 11.

INDUSTRIAL APPLICABILITY AND ADVANTAGES

The present invention is useful in the field of ink jet printing, and has the advantage of providing an integral print engine module containing critical units of an ink jet printer. The present invention provides the further advantage of having retractor means for containing cables for each unit. Finally, it is an advantage of the print engine module of the present invention that it contains removable and replaceable units which are easily built, tested, and installed in the print engine cabinet.

Having described the invention in detail and by reference to the preferred embodiment thereof, it will be apparent that other modifications and variations are possible without departing from the scope of the invention defined in the appended claims.

We claim:

1. An integral print engine module for a continuous ink jet printer having a remote print head, comprising:

a. a removable fluid system unit, the fluid system unit including,
   a fluid system,
   cables associated with the fluid system,
   retractor means for containing the cables,
   means for mounting the fluid system within the integral print engine module, and
   an umbilical interface;

b. a removable charge power unit;

c. a removable power supply unit; and d. a removable card cage assembly unit.

2. An integral print engine module as claimed in claim 1 wherein the charge power unit comprises:

a. a programmable power supply;

b. a power source for supplying power to the programmable power supply;

c. an AC power conditioner for providing power to a control means and the power supply unit;

d. cables associated with the charge power unit; and e. retractor means for containing the cables.

3. An integral print engine module as claimed in claim 2 wherein the charge power unit further comprises:

a. a vacuum pump; and b. ink heater means.

4. An integral print engine module as claimed in claim 1 wherein the power supply unit comprises power supply means for supplying power to the fluid system unit and the print head.

5. An integral print engine module as claimed in claim 1 wherein the card cage assembly unit comprises a print engine mother board.

6. An integral print engine module as claimed in claim 5 wherein the card cage assembly unit further comprises a plurality of daughter boards.

7. An integral print engine module as claimed in claim 5 wherein the card cage assembly unit further comprises a retractor means for containing a plurality of cables.

8. An integral print engine module as claimed in claim 1 further comprising:

a. a power distribution unit; and b. a computer unit.

9. An integral print engine module as claimed in claim 8 wherein the power distribution unit comprises means for providing AC power to the print engine module.

10. An integral print engine module as claimed in claim 9 wherein the power distribution unit further comprises a circuit breaker for providing protection to the print engine module and having means for disconnecting all power within the print engine module.

11. An integral print engine module as claimed in claim 8 wherein the computer unit comprises control means for the print engine module and the remote print head.

12. An integral print engine module as claimed in claim 11 wherein the control means comprises:

a. a display means; and b. a data entering means.

13. An integral print engine module as claimed in claim 12 wherein the display means comprises a CRT monitor.

14. An integral print engine module as claimed in claim 12 wherein the data entering means comprises a keyboard.

* * * * *